US006168441B1

(12) United States Patent
Buchart

(10) Patent No.: US 6,168,441 B1
(45) Date of Patent: Jan. 2, 2001

(54) CONTACT ELEMENT

(75) Inventor: Peter Buchart, Bavaria (DE)

(73) Assignee: FCT Electronic GmbH, Munich (DE)

( * ) Notice: Under 35 U.S.C. 154(b), the term of this patent shall be extended for 0 days.

(21) Appl. No.: 08/984,273

(22) Filed: Dec. 3, 1997

(30) Foreign Application Priority Data

Mar. 7, 1997 (DE) ..... 297 40 161 U

(51) Int. Cl.[7] ..... H01R 9/09
(52) U.S. Cl. ..... 439/82; 439/751
(58) Field of Search ..... 439/82, 751, 851

(56) References Cited

U.S. PATENT DOCUMENTS

| | | | | |
|---|---|---|---|---|
| 2,814,024 | * | 11/1957 | Narozny | 439/82 |
| 2,877,441 | * | 3/1959 | Narozny | 439/82 |
| 4,526,429 | * | 7/1985 | Kirkman | 439/751 |
| 4,752,250 | * | 6/1988 | Seidler | 439/82 |
| 4,917,630 | | 4/1990 | Hubbard | 439/578 |

FOREIGN PATENT DOCUMENTS 92 18 128 10/1994 (DE) .

OTHER PUBLICATIONS

English Translation of German Patent No. G 92 18 128.7.

* cited by examiner

*Primary Examiner*—Neil Abrams
*Assistant Examiner*—T C Patel
(74) *Attorney, Agent, or Firm*—Cummings & Lockwood

(57) ABSTRACT

A contact element for insertion and fastening in a through-contacted borehole provided in a carrier, for example, a printed circuit board, is disclosed. The contact element has a fastening region provided for insertion into the borehole, a connection region lying opposite the fastening region for connecting a plug, and a base region lying between the fastening and connection regions. The fastening region includes a pin having a collar at a distance from base region. The collar forms an application surface on the carrier, and the pin has a slot-shaped cutout extending over its entire length proceeding from base region of contact element up to its free end.

14 Claims, 1 Drawing Sheet

FIG. 1
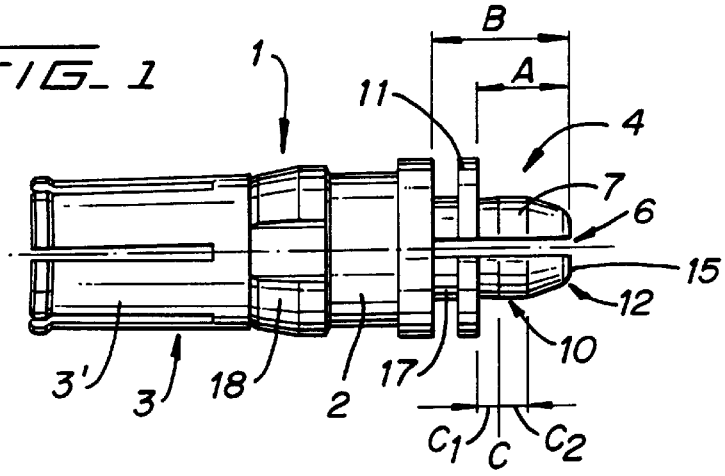
FIG. 2A
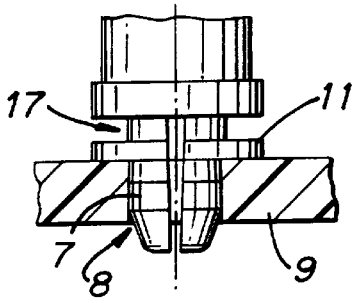
FIG. 2B
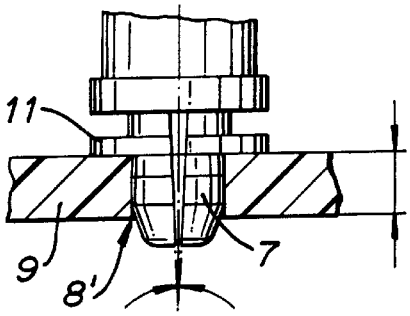
FIG. 3A
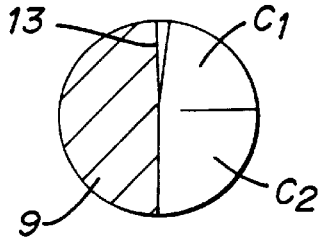
FIG. 3B
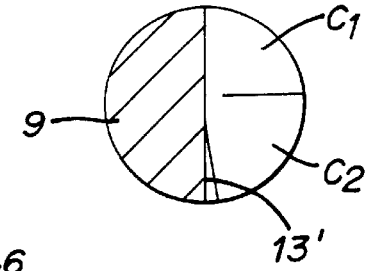
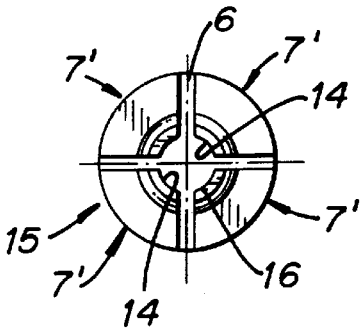
FIG. 4

CONTACT ELEMENT

BACKGROUND OF THE INVENTION

The invention concerns a contact element for insertion and fastening in through-contacted boreholes, which are provided in a printed circuit board or similar contact carriers for uptake of such contact elements, whereby the contact element has a fastening region provided for insertion in the borehole, a connection region lying opposite this fastening region, for connecting, for example, a plug, and a base region lying between the two.

Such known contact elements may be formed in two parts, so that they may consist of different materials that are optimally adapted to the respective purpose of application. Thus, for example, contact springs are provided in the connection region of such a contact element, and these springs must consist of a material that has sufficient spring properties in order to hold the plug to be attached thereon. On the other hand, however, the fastening region provided for inserting into the borehole of the printed circuit board will consist of a material that is excellently suitable for contacting the electrically conducting material provided in the borehole of the printed circuit board and particularly for conducting high current loads.

For this reason, in the case of this known contact element, a base region is provided in which the fastening region on the one hand and the connecting region on the other hand can be joined together.

As described in DE-GM Utility Model 92 18 128.7, these known contact elements are formed as posts in their fastening region, which has a press-in segment that can be taken up by a through-contacted printed-circuit-board uptake of a printed circuit board. The uptake of the printed circuit board is thus shaped as a socket of metal, whose hardness is different when compared to the hardened press-in segment of the post. These known contact elements also have another threaded segment connecting thereon for the press-in segment on the post, and this threaded segment projects from the printed circuit board and a nut can be screwed on it. With the intermediate placement of a washer, the contact element can be securely fastened onto the printed circuit board.

A disadvantage in this known contact element is the fact that the fastening process on the printed circuit board not only consists of the fact that the contact element is inserted in the uptake of the printed circuit board, designed, for example, as a borehole, but also a metal socket is to be provided in the uptake of the printed circuit board, and further, the lock-nut with washer must be placed on and fastened after the contact element is inserted.

SUMMARY OF THE INVENTION

The task of the present invention is to improve the known contact element extensively such that the arrangement of a lock-nut with washer and also the special arrangement of a metal socket in the uptake of the printed circuit board are not necessary, but rather the contact element can be inserted in a simple way with its fastening region in boreholes of different diameter provided in the printed circuit board of variable thickness, whereby the electrical contact of the contact element with the electrically conducting surfaces of the printed circuit board in the region of the uptake of the printed circuit board, i.e., the borehole, is produced immediately and completely, without these contact surfaces being plastically deformed and for the rest, the fastening region will be made relatively short in design.

This task is resolved in a contact element of the type named initially by the fact that the fastening region is formed as a pin, which has a collar at a distance from the base region, which collar forms an application surface on the printed circuit board or the contact carrier and such that the pin has a slot-shaped cutout proceeding from the base region of the contact element up to its free end.

This particular design of the fastening region as a pin provided with a slot, which pin has a collar provided at a distance from the base region of the contact element, which collar is applied against the printed circuit board, assures that the contact element is not inserted over the complete length of the pin, thus up to the base region, for example, when it is inserted by machine, into the borehole provided in the printed circuit board, but rather only up to lengths reaching to the collar. It is a prerequisite that the diameter of the pin in this fastening region is larger than the diameter of the borehole provided in the printed circuit board, so that the pin formed in at least two parts can be easily pressed through the slot-shaped cutout and develops, with suitable selection of an appropriate material, an elastic spring force that holds the contact element in the borehole and at the same time also produces electrical contact with the electrical contact surfaces of the printed circuit board in or at this borehole, whereby also another electrical contact surface is produced by the collar applied on the printed circuit board, which collar also axially aligns the contact element.

It is advantageous if the slot-shaped cutout is formed in the shape of a cross and the pin is thus made of four parts.

This particular design of the pin assures a still more flexible and more optimal insertion of the pin parts into the borehole provided in the printed circuit board, which also assures a perfect contact in such boreholes, which are not formed in a completely cylindrical manner.

The same is true also for the case when the pin loses its originally precise rotation-symmetric form in the production of the cutout, so that the pin parts are well applied to the inner wall of the borehole, so that a perfect current flow is assured.

In another advantageous embodiment, the pin is shaped on its free end in a truncated-cone shape, whereby the edges produced at the end and the edges found in the transition to the fastening region are rounded.

By this special design of the tip region of the pin, the latter finds its way also without great resistance into the borehole provided in the printed circuit board, even if it is not aligned precisely centrally on the borehole or is axially tipped, for example, when the fitting of a printed circuit board with such contact elements is conducted by machine.

In another embodiment of the contact element according to the invention, the pin has at least two different diameters in its insertion region connected directly to the collar and extending up to approximately the truncated-cone-shaped end.

This embodiment assures that one and the same contact element can be inserted into boreholes of different diameter.

Advantageously, the segment of the insertion region with the smaller diameter is connected directly to the collar, and the segment of the insertion region with the larger diameter is further connected thereon, whereby the transition between the two diameter regions is smooth and not step-shaped and whereby it is also assured that the impression force remains relatively constant.

The arrangement of insertion regions having different diameters in the above-described sequence assures that if the pin is inserted into a borehole having a smaller diameter, it projects with its entire insertion region into the through-contacted borehole up to the stop on the collar and thus also with a smaller diameter of the borehole, the entire insertion region contributes to fixing the contact element in the borehole of the printed circuit board.

Advantageously, the pin has on the front side of its truncated-cone-shaped tip region a borehole, which increases the distance of the parts of the pin projecting through the slot from one another, so that the latter do not come into contact, if the contact element is inserted with its pin into a narrower borehole. This design protects the parts of the pin from a plastic deformation.

In another embodiment according to the invention, the diameter of the pin is shaped differently in its region between the collar on the one hand and the base region of the contact element on the other hand, when compared with its diameter in the insertion region.

The impression force to be introduced for insertion of the contact element into the borehole provided in the printed circuit board is established according to the selection of the diameter in this region.

The same applies also, if the part between the collar on the one hand and the base region of the contact element on the other hand is of different length. Also, the insertion force to be introduced for inserting the contact element in the borehole provided in the printed circuit board is established thereby.

BRIEF DESCRIPTION OF THE DRAWINGS

A nonlimiting example of embodiment of the invention will be described below on the basis of the figures shown in the drawings.

FIG. 1: A lateral view of the complete contact element,

FIG. 2*a*: The contact element inserted into a borehole of larger diameter,

FIG. 2*b*: The contact element inserted into a borehole of smaller diameter, FIG. 3*a*: An enlarged representation of the contact region between the pin on the one hand and the inner surface of the borehole on the other hand for a borehole of larger diameter, FIG. 3*b*: An enlarged representation of the contact region between the pin on the one hand and the inner surface of the borehole on the other hand for a borehole of smaller diameter, and FIG. 4: A view of the front side of the pin having a crossed slot.

DETAILED DESCRIPTION OF THE PREFERRED EMBODIMENT

The rotation-symmetric contact element 1 shown in the figures essentially comprises a central base region 2, which has on its first end a connection region 3 and on its other end a fastening region 4, whereby contact region 3 is configured as an insertion socket comprised of individual spring-type tips 3', and fastening region 4 is configured as a pin 7 having a crossed slot 6.

This contact element 1 is particularly suitable for the purpose of being inserted by machine into borehole 8 or 8', which are provided, for example, in printed circuit board 9, whereby the thickness of the printed circuit board is not limited upwardly. Therefore, these boreholes 8 and 8' may have different diameters, i.e., as shown in FIG. 2A, a larger diameter, and as shown in FIG. 2B, a smaller diameter.

The fastening region 4 of contact element 1 formed as pin 7 is inserted into this borehole 8 or 8' having a larger or smaller diameter, as shown in FIGS. 2A and 2B, and this is done via its insertion region 10 up to the stop at a collar 11 formed on pin 7. This collar 11 is arranged on pin 7 at a distance to base region 2 of contact element 1, whereby the cross-shaped slot 6, however, extends over the complete insertion region 10 up to base region 2 of contact element 1.

Thus length A of total length B of pin 7 remains for fastening, i.e., inserting or impressing contact element 1 into borehole 8 or 8'.

This insertion region 10 of pin 7 with its length A is again subdivided into two regions, i.e., contact region C properly speaking and tip region 12, which is formed approximately as a truncated cone. It is assured by this special configuration of pin 7 that the latter also finds its way without force when contact element 1 is fixed onto printed circuit board 9, if it is not precisely centered or arranged prior to introduction into borehole 8 or 8'. This tip region 12, so to speak, forms a sufficiently effective guide of contact element 1 when inserted into printed circuit board 9.

Contact region C is in turn divided into two different contact regions C1 and C2 having different diameters, whereby region C1 has a smaller diameter than region C2.

The position of these respective contact regions C1 and C2 is shown in FIGS. 3A and 3B as a function of the diameter size of borehole 8 or 8'.

In the case of the larger borehole 8, there is essentially applied only contact region C2 at the inner wall 13 of borehole 8, while in the case of borehole 8' having a smaller diameter, in contrast, contact region C1 is almost exclusively applied to inner wall 13' of borehole 8'.

However, contact element 1 may also be inserted in boreholes with intermediate-size diameters, although, of course, pin 7 does not experience a complete application region according to C1 or C2 at inner wall 13 of the borehole, whereby a complete current roadability will not be given.

Depending on whether pin 7 divided into four parts by crossed slit 6 is inserted into the narrower or the wider borehole 8 or 8', the edges 14 of these pin parts 7' adjacent to crossed slit 6 approach each other, and in order to avoid a contacting of these pin parts 7', whereby a plastic deformation would be experienced by these and contact element 1 could not be inserted into printed circuit board 9 without pinching, a recess in the form of a borehole 16' is provided in front side 15 of tip region 12 of pin 7.

When compared with all other contact elements known from the state of the art, the above-described contact element 1 according to the invention has the advantage that it can be inserted without difficulty, particularly with a relatively constant impression force during the entire insertion process, particularly also in the case of machine equipping of printed circuit boards 9 with contact elements 1, into boreholes 8 or 8' provided therein, whereby different borehole diameters may be provided. Also, in the case of relatively small dimensional inaccuracies with respect to centering the contact element 1 to be inserted in front of boreholes 8 or 8' to receive it, contact element 1 can be inserted in borehole 8 or 8' without plastically deforming the contact surfaces, whereby above all, a solid seating of contact element 1 is assured such that pin 7 has a crossed slot 6, which extends not only over the entire length A of insertion region 10, but also over the entire length B of fastening region 7, i.e., over the entire length of pin 7 formed on base region 2 of contact element 1.

Part 17 of pin 7 lying between collar 11 and base region 4 may have a variable diameter, and the elasticity and compliance of the corresponding parts 7' of pin 7 are influenced by the selection of the respective diameter.

This configuration of pin 7 of contact element 1, in particular, assures a disruption-free insertion into boreholes 8 or 8' provided with electrically conducting metal contact surfaces, since care is taken that parts 7' of pin 7 are configured in an elastically compliant manner by means of crossed slot 6 and particularly borehole 16 provided in front side 15. In this way, pin 7 can be inserted or pressed into borehole 8 or 8' without damaging the electrically conducting contact surfaces in borehole 8 or 8' of printed circuit board 9.

In this form of embodiment, base region 2 has a spring element 18, which is applied to connecting region 3, and which is specified as a spring-type seating of a plug part having contact elements 1, not shown in the figures.

What is claimed is:

1. A contact element for insertion and fastening in a borehole provided in a carrier, comprising:

(a) a connection region having a connection end and a base end for connecting a plug at the connection end;

(b) a base region adjacent to the base end of the connection region, and (c) a pin having a first end adjacent to the base region and a second end terminating at a distance from the base region, wherein the pin has a collar positioned between the first end and the second end for forming an application surface on the carrier upon insertion of the pin into the borehole, wherein the pin has a slot-shaped cutout extending from the first end to the second end, and wherein, upon insertion of the contact element into the borehole, a portion of the pin between the collar and the second end exerts a force on the carrier to cause the contact element to remain therein.

2. The contact element of claim 1, wherein the slot-shaped cutout is formed in a cross shape so that the pin comprises four parts.

3. The contact element of claim 1, wherein the portion of the pin between the collar and the second end terminates in a truncated-cone shape.

4. The contact element of claim 1, wherein the portion of the pin between the collar and the second end has at least two different diameters.

5. The contact element of claim 4, wherein a segment of the portion of the pin between the collar and the second end having the smaller of the at least two diameters is adjacent to the collar.

6. The contact element of claim 4, wherein a transition between the portion having the smaller diameter and the portion having the larger diameter is smooth.

7. The contact element of claim 1, wherein the pin has a borehole therein parallel to the slot-shaped cutout.

8. The contact element of claim 7, wherein the pin borehole is concentric within the pin.

9. The contact element of claim 7, wherein the pin borehole extends from the second end to the collar.

10. The contact element of claim 1, wherein a portion of the pin between the base region and the collar has a first diameter, wherein a portion of the pin between the collar and the second end has a second diameter, and wherein the first diameter is different from the second diameter.

11. The contact element of claim 1, wherein the carrier comprises a printed circuit board.

12. The contact element of claim 1, wherein the connection region and the pin comprise different materials.

13. The contact element of claim 12, wherein the connection region and the base region comprise different materials.

14. A contact element for insertion and fastening in a borehole provided in a carrier, comprising:

(a) a connection region having a connection end and a base end for connecting a plug at the connection end;

(b) a base region adjacent to the base end of the connection region, and (c) a pin having a first end adjacent to the base region and a second end terminating at a distance from the base region, wherein the pin has a collar positioned between the first end and the second end for forming an application surface on the carrier upon insertion of the pin into the borehole, wherein the pin has a slot-shaped cutout extending from the first end to the second end, and wherein the pin has a borehole therein parallel to the slot-shaped cutout.

* * * * *